US005707306A

United States Patent [19]

Boden

[11] Patent Number: 5,707,306

[45] Date of Patent: Jan. 13, 1998

[54] TENNIS RACKET STRINGING PATTERN AND METHOD THEREFOR

[76] Inventor: Robert O. Boden, 1580 Gaywood Dr., Altadena, Calif. 91001-1841

[21] Appl. No.: 597,809

[22] Filed: Feb. 7, 1996

[51] Int. Cl.[6] ..... A63B 51/00

[52] U.S. Cl. ..... 473/543

[58] Field of Search ..... 473/520, 522, 473/533, 543

[56] References Cited

U.S. PATENT DOCUMENTS

| | | | |
|---|---|---|---|
| 1,733,960 | 10/1929 | Godfrey | 473/543 |
| 3,834,699 | 9/1974 | Pass | 273/73 D |
| 4,013,289 | 3/1977 | Kaminstein | 273/73 D |
| 4,076,241 | 2/1978 | Newsome | 473/543 |
| 4,093,220 | 6/1978 | Prewarski | 473/543 |
| 4,190,249 | 2/1980 | Fischer | 273/73 D |
| 4,249,731 | 2/1981 | Amster | 473/543 |
| 4,273,331 | 6/1981 | Fischer | 273/73 D |
| 4,299,385 | 11/1981 | Boden | 273/73 D |
| 4,458,898 | 7/1984 | Boden | 273/73 D |
| 4,488,722 | 12/1984 | Harz | 473/543 |
| 4,685,676 | 8/1987 | Boden | 273/73 D |
| 5,169,146 | 12/1992 | Soong | 473/522 |

*Primary Examiner*—William E. Stoll
*Attorney, Agent, or Firm*—Christie, Parker & Hale, LLP

[57] ABSTRACT

A racket with a stringing pattern utilizing at least one string has two fully interwoven string regions and a partially interwoven string region interposed between the two fully interwoven string regions. At the boundaries between the regions elastomeric anchoring tubes with the strings passing therethrough space the cross strings from the main strings so that spin is easily imparted to a ball struck by the racket and balls with spin are easily received and returned. In the partially interwoven region, the string is strung in three planes. A racket stringing kit provides at least one string and at least one tubular anchor having an outer diameter sufficiently greater than the string diameter to space the main strings from the cross strings in the partially interwoven string region. A method of completing the string pattern comprises inserting the string through a hole in the racket head and inserting the string through a first anchoring tube. The string is then inserted through second and third holes in the racket head and following that a second anchoring tube. After the second anchoring tube the string is inserted through a fourth hole in the racket head and knots are tied at the end of the string.

14 Claims, 2 Drawing Sheets

48
25
34
40
38
2
28
36
24
32
30
25
26
48
20
22

TENNIS RACKET STRINGING PATTERN AND METHOD THEREFOR

BACKGROUND OF THE INVENTION

This invention relates to rackets, racket stringing patterns, racket stringing kits, and methods for stringing rackets.

A popular technique in racket sports involves striking a ball in a manner that imparts spin to the ball. The game of tennis is a racket sport in which imparting spin to the tennis ball is an important part of play. In the game of tennis, one way to impart spin to the tennis ball is for a player to position the head of the tennis racket obliquely relative to the direction of travel of the tennis ball. Further, spin is imparted to a tennis ball when a player positions the head of the tennis racket approximately perpendicular to the direction of travel of the tennis ball and moves the racket head in a direction orthogonal to the impact trajectory of the tennis ball on the racket. When a player imparts spin to the balls, it produces an angular rotational momentum which affects the trajectory and bounce of the balls.

The use of top spin causes a ball, which might otherwise land out of the court, to drop within the court even though it may be travelling at a high rate of speed. When a ball with top spin bounces on the playing surface the ball will receive an extended trajectory after its bounce because the angular momentum is translated into linear velocity by the playing surface. Back spin can also be applied to a tennis ball. When a ball with back spin strikes the court it tends to bounce in a more shallow trajectory and over a shorter distance. Further, a lateral cut, or slice, can be applied to a tennis ball. This has a lateral effect on the trajectory of the ball both before and after the ball bounces on the playing surface. In general, using available stringing patterns, kits, and methods, which are practical for use, the technique of applying different spins such as back spin, top spin, and slice to a ball are mastered only after years of participation in the desired racket sport. Further, considerable skill and experience is required to competently receive and return balls having substantial angular velocities such as those described above.

Thus, a stringing pattern, stringing kit, and method for stringing a racket simplifying the application of spin to a ball and simplifying the return of balls having such spin is desirable to train new players and enhance play.

SUMMARY OF THE INVENTION

There is, therefore, provided in the practice of this invention a racket with a novel stringing pattern. The racket has a handle, head, and a plurality of strings extending in at least two directions. The pattern comprises a fully interwoven string region which is interwoven in two directions and a partially interwoven string region which is interwoven in only one direction. The partially interwoven string region is positioned adjacent to the fully interwoven string region, and an anchoring member defines the boundary between the two string regions.

In a preferred embodiment, the anchoring member is a tube, with one of the strings extending through the anchoring member. The anchoring member has an outer diameter that is sized so that the strings extending in the other direction are displaced from their at rest position upon contact with an object so that the object stays in contact with the strings for a relatively long period of time. To obtain this displacement, the outer diameter of the anchoring member is sized so that in the partially interwoven region, the string extending in one direction does not contact the strings extending in the other direction when both are at rest. Further, the pattern comprises a second fully interwoven string region adjacent to the partially interwoven string region so that the second fully interwoven string region is opposite to the first fully interwoven string region. The boundary between the second fully interwoven string region and the partially interwoven string region is defined by a second anchoring member. Preferably the anchors extend across the width of the tennis racket and are interwoven only in the cross-string direction. Thus, the partially interwoven string region is interwoven in a cross-string direction, and the fully interwoven string region is interwoven in both the cross-string direction and a main string direction.

There is still further provided in the practice of this invention a novel racket comprising a handle and a head connected to the handle. The head of the racket defines an opening across which a plurality of strings are strung for the purpose of striking an object. The strings extend in at least two directions across the opening. A lower string region is interwoven in two directions and is adjacent to the handle. An upper string region interwoven in two directions is also provided. The upper string region is located opposite the handle. Interposed between the lower and upper string regions is a middle string region in which the strings are separated into three planes. Two partially interwoven anchoring members are placed at the boundary between the lower string region and the partial string region and at the boundary between the upper string region and the partially interwoven string region.

In a preferred embodiment, the cross strings are in a middle plane and the main strings are divided evenly between a first outer plane and a second outer plane on opposite sides of the middle plane. The three planes are preferably parallel and spaced apart. Further, a plurality of vibration dampening components are provided to dampen the vibration from the portions of the string extending in the cross-string direction, and the sweet spot of the racket, which is typically located in the center of the opening of the racket head, coincides with the placement of the partially interwoven string region.

There is further provided in the practice of this invention a novel stringing kit comprising at least one string and at least one anchor. The anchor is tubular and has an inner-diameter sized to receive the string. The outer diameter of the anchor is sufficiently greater than the diameter of the string so that the main strings are spaced from the cross strings in the partially interwoven string region of the racket.

In a preferred embodiment, a second anchor is provided with an outer diameter similar to the outer diameter of the first anchor. The anchor is composed of elastomeric tubing, and in one embodiment has a length approximately twice the width of the racket head, so that it may be cut in two, thereby forming the two anchors. The string preferably has a size of approximately 15 gauge, and the anchor preferably has a hardness in the range of 75 to 90 inclusive on the Shore A scale and an outer diameter of approximately 0.2 inches.

There is still further provided in this invention a method of stringing an opening in a racket head having a top, bottom, and a plurality of string holes. The method comprises inserting the string through a first hole in the racket head, a first anchoring tube, second and third holes in the racket head, and through a second anchoring tube. Further, the string is inserted through a fourth hole in the racket head, and first and second knots are tied at the ends of the string.

In a preferred embodiment of the method, the string is tensioned to the maximum tension recommended by the manufacturer. The step of inserting the string through the first hole comprises inserting one end of the string through the first hole, and the step of inserting the string through the first anchoring tube comprises inserting the same end of the string through the first anchoring tube. Further, the step of inserting the string through the second hole comprises inserting the same end through the second hole. The top three cross strings are fully interwoven, as are the bottom three cross strings. The cross strings between the top and bottom three cross strings are partially interwoven. The fourth cross string from the top and the fourth cross string from the bottom are preferably the strings inserted through the upper and lower anchoring tubes.

These and other features and advantages of the present invention will appear from the following Detailed Description and the accompanying drawings in which similar reference characters denote similar elements throughout the several views.

DETAILED DESCRIPTION

Figure 1:
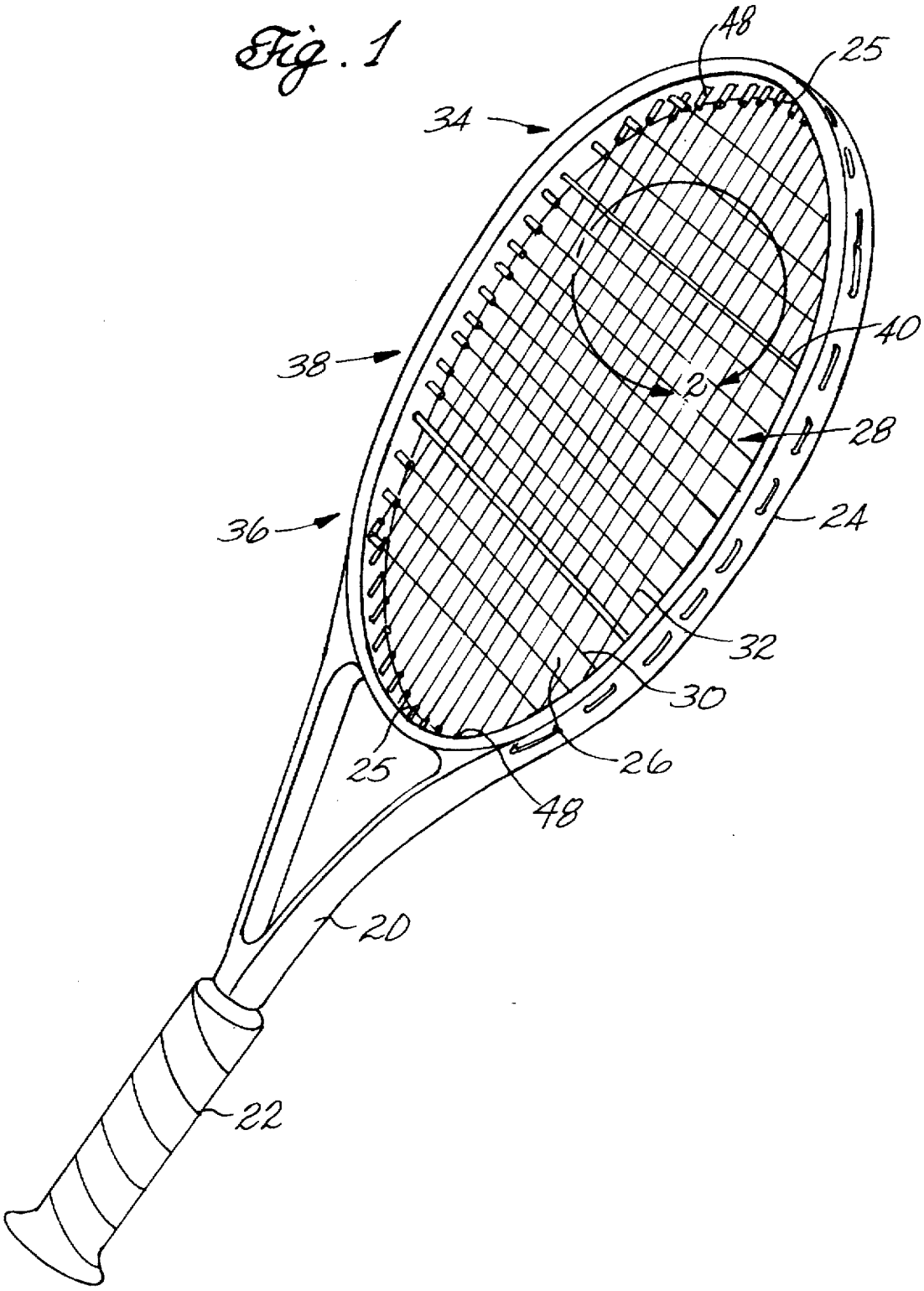
FIG. 1 is a perspective view of a tennis racket according to the present invention.

FIG. 1 shows a tennis racket with a tennis stringing pattern according to the present invention. The racket has a handle 20 terminating at one end with a grip 22 which is grasped for play. The other end of the handle terminates in a head 24 which defines a central opening 26. In use, at least one string, generally designated 28, is strung across the opening for the purpose of striking objects. Portions of the string extend in a first cross-string direction, and other portions of the string extend in a second main string direction. The head of the racket has string holes 25 spaced around the circumference of the racket head. The string is inserted through the holes during the stringing process. Though there is typically only one or two strings used to string a racket, it is common for sake of clarity to refer to the racket as having many strings. In this terminology, a string is defined as a portion of the string that extends from one hole to an opposite hole across the opening. Consistent with that common terminology, the racket shown has eighteen cross strings 30 and sixteen main strings 32. The cross strings are generally perpendicular to the handle of the racket, and the main strings are generally parallel with the handle of the racket. Thus, the main strings are substantially perpendicular to the cross strings.

In the preferred embodiment shown, the racket is strung so that there are three discrete regions. The upper region, generally designated 34, which is at the top of the racket head and thus opposite the handle, is fully interwoven. The lower region, generally designated 36, which is at the bottom of the racket head and thus adjacent the handle, is also fully interwoven. The middle region, generally designated 38, is interposed between the lower and upper regions, and the middle region is only partially interwoven. The terms fully interwoven and partially interwoven will be defined below. Preferably the middle region coincides with the sweet spot of the racket which is generally in the center of the opening in the head of the racket.

Figure 2:
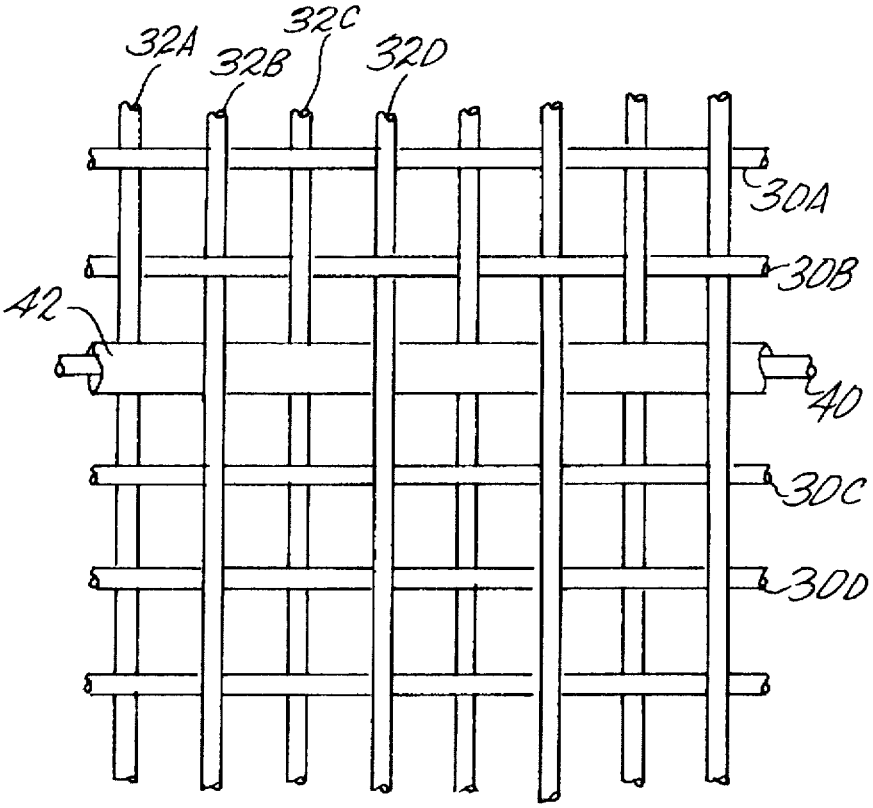
FIG. 2 is a partial view of a stringing pattern used in the racket of FIG. 1 taken from within the closed line 2 of FIG. 1.

Referring to FIG. 2, fully interwoven, as used herein, simply means that the cross strings are interwoven through the main strings out of phase. That is, moving along a main string, the cross strings alternate passing above and below the main string, and moving along a cross string the main strings also alternate, passing above and below the cross string. In detail, the first, top cross string 30A shown in FIG. 2 passes over the left, first main string 32A. However, the second cross string 30B passes underneath the first main string 32A. Further, each of the cross strings 30A, 30B alternate above and below the main strings along their length. Cross string 30A passes above the first main string 32A and below the second main string 32B. Thus, in the fully interwoven regions, each main string alternates above and below the cross strings, and each cross string alternates above and below the main strings. Therefore, the fully interwoven region is interwoven in both the cross string and main string directions.

As stated, the middle region is partially interwoven. As used herein, partially interwoven means the cross strings are interwoven through the main strings in phase with each other. That is, adjacent cross strings 30C, 30D pass on the same side of the first main string 32A, and the adjacent cross strings 30C, 30D also pass on the same side of the second and third main strings 32B, 32C. Each individual cross string alternates above and below the main strings along its length, but each of the main strings stays on the same side of the cross strings. The main strings do not alternate above and below the cross strings. Thus, the partially interwoven region is interwoven only in the cross-string direction.

In the middle region, the strings are preferably separated into three parallel planes. The cross strings are in an inner, middle plane, and the main strings are split into first and second outer planes with the first outer plane on one side of the middle plane and the second outer plane on the other side of the middle plane. Thus, the cross strings are in between the main strings. In the preferred embodiment shown, half of the main strings are in the first outer plane, and the other half of the main strings are in the second outer planes. Further, the main strings alternate between the outer planes, so that the first and third main strings 32A, 32C are in the first outer plane, and the second and fourth main strings 32B, 32D are in the second outer plane. Thus, the adjacent main strings are in opposite outer planes. Also, the three planes are spaced apart not only to reduce wear and tear due to rubbing friction between the strings, but also to allow the strings to displace a greater distance than in a conventional racket, so the ball remains on the strings longer for better control and more spin. Preferably the planes are spaced apart an equal distance.

In the preferred embodiment shown, the fourth cross string 40 from the end of the racket opposite the handle passes through an upper anchoring member 42 which is interwoven so that it is out of phase with the adjacent cross string 30B in the upper fully interwoven region and in phase with the adjacent cross string 30C in the middle partially interwoven region. Thus, the fourth cross string alternates above and below the main strings, but the main strings stop alternating above and below the cross strings at the fourth cross string. Therefore, the anchoring member forms a boundary between the fully interwoven region and the partially interwoven region of the tennis racket stringing pattern. Further, the anchor is only interwoven in the cross-string direction. The fourth cross string 40A from the end of the racket adjacent the handle is also passed through a second, lower anchoring member 42A, which is interwoven similar to the upper anchor 42. The lower anchor 42A defines the boundary between the middle and lower regions. Further, the anchoring members prevent string wear which would occur between the fourth cross strings and the main strings because of the increased freedom for the strings to deflect.

As shown in FIG. 1, there are preferably three cross strings in each of the fully interwoven regions, and ten cross strings in the partially interwoven region. More or fewer cross strings can be used in each region depending on several factors including the size of the racket and the total number of cross strings.

The anchoring member is preferably an elastomeric tube having an inner diameter of 1/16 inch and an outer diameter of 3/16 inch. The length of the anchor is selected so that it can extend across the width of the racket being strung. The inner diameter is sized so that it receives the string which is preferably 15 gauge. The anchoring member holds the main strings, which extend perpendicular thereto, in the same position relative to the anchoring member, and the outer diameter of the anchor is sufficient to space the main strings from the cross strings in the partially interwoven region of the stringing pattern. Thus, the main strings can easily deflect in the plane of the racket head. At the least, the outer diameter of the anchor should be great enough to allow the deflection of main strings more easily than in the fully interwoven region.

The materials for the stringing pattern excluding the racket are provided in a racket stringing kit. The kit includes at least one string and at least one but preferably two anchoring members. As described, the string is preferably a relatively thick string of approximately 15 gauge. Further, the string is approximately three (3) feet in length. The anchor is approximately the size described above. Two anchors are preferably provided in one piece of tubing. Thus, the tubing is approximately twice the length of the width of the tennis racket at the position of the fourth cross strings. Typically, eighteen (18) inches is a sufficient length. When two anchors are provided in one piece, the tubing is cut into two pieces for use in the pattern. Another property of the anchor is its hardness. Preferably the elastomeric tubing has a hardness of approximately 75 to approximately 90 on the Shore (Scleroscope) A scale, the A scale being used for softer materials. If the hardness is significantly above 90, the main strings tend to slide over the anchor, and though some players may prefer a softer anchor for vibration purposes, if the hardness is significantly below 75, the strings quickly cut into and wear out the anchor.

Figure 3:
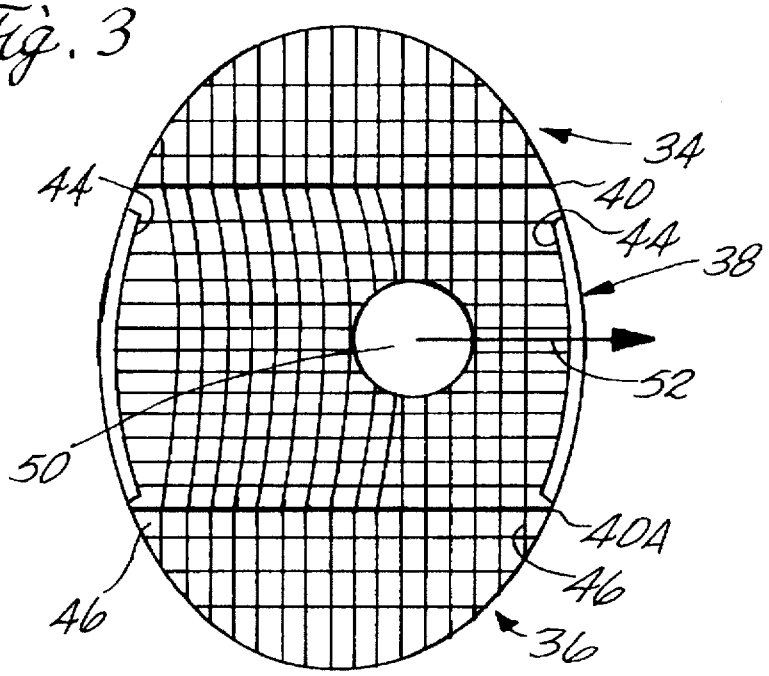
FIG. 3 is a schematic view of the head of the racket of FIG. 1 illustrating string deflection.

Referring to FIG. 3, the anchors do perform a vibration dampening function because of their elastomeric nature. For some players, additional vibration dampening elements 44 will be desired. Because the elastomeric anchors effectively dampen vibration from the main strings, the additional vibration dampening elements are preferably used to dampen the vibration from the cross strings as shown in FIG. 3. Any conventional vibration dampening element can be used, or elastomeric tubing according to the present invention can be used on the outer main strings 46.

The racket is strung, for the most part, in accordance with the manufacturer's instructions for stringing the racket with the following modifications. Prior to weaving the fourth cross string 40 from the end of the racket head opposite the handle (top), the string is inserted through the upper anchor 42. Thus, the string is inserted through a first hole in the racket head corresponding to the fourth cross string, inserted through the anchoring member, and inserted through a second hole in the racket head which is preferably opposite the first hole. The cross strings above the anchor on the fourth cross string from the top are interwoven with the main strings out of phase, as is conventional, to form the upper fully interwoven region, and the cross strings below the anchor are interwoven with the main strings in phase to form the middle partially interwoven region. Prior to weaving the fourth cross string from the end of the racket head adjacent the handle (bottom), the string is inserted through the lower anchor 42A. Thus, the string is inserted through a third hole in the racket head corresponding to the lower fourth cross string, through the anchor, and through a fourth hole in the racket head opposite the third hole. The cross strings below the fourth cross string from the bottom are interwoven out of phase to form the lower fully interwoven region. Once the stringing pattern is completed, knots 48 (FIG. 1) are tied at the ends of the string to secure the pattern in the racket head. Though the fourth cross strings are used as the anchors in the described embodiment, other cross strings in different positions can be used.

In a preferred embodiment, the racket is strung to the highest manufacturer recommended tension to avoid trampoline action, and the above steps are performed by inserting the same end of the string through the string holes and the anchoring members. The above method for stringing a racket is no slower than conventional methods because of the partial interweaving in the middle region. And this method is significantly faster than the previous ones specifically designed to enhance the spin characteristics. Further, this stringing method can be completed even faster if the cross strings are strung first. If the main strings are completed after the cross strings, there is no interweaving performed in the partially interwoven region. The main strings are alternately lain over the top and the bottom of the cross strings. This leads to completion of the racket stringing in a shorter period of time than was before possible.

In operation, a ball 50 traveling in the direction of arrow 52 strikes the strings in the partially interwoven region 38 between the anchors. Because the strings in this region are not fully interwoven, they are free to deflect as illustrated in the plane of the racket head. Further, with the main strings spaced from the cross strings, fewer strings are effectively contacting or influencing the ball and thus the strings deflect even further. The reasoning behind this is subtle and thus not immediately discernible. In particular, half of the main strings which contribute 25% of all strings (the ones furthest from the ball) can move independently of all the other strings in the direction of ball impact. But the cross strings which contribute 50% of all strings can move independently only from the other half of the main strings (the ones closest to the ball). And this latter half of the main strings cannot move independently from any of the other strings. If we assign 100% as the value of resistance of the stringbed within the sweet spot of a conventionally strung racket, then we may approximate that of the present invention as (25%)(25%)+(50%)(75%)+(25%)(100%)=68.75%. Thus, effectively only approximately 70% of the strings are bearing 100% of the load. This result comes from the partial interwoven structure of the strings. This has the effect of keeping the ball on the racket strings longer, and thus, the ball is easier to control. Further, because the ball is on the racket string longer, the movement of the racket and angle of the racket head with the trajectory of the ball impart greater spin to the ball. For example, in FIG. 3, if a top spin shot is hit, the strings tend to deflect in the direction opposite the racket travel and in the direction of ball travel, thereby imparting a clockwise top spin, viewed A to B, onto the ball. The top spin is greater than with conventional rackets because of the string deflection which keeps the ball in contact with the string for a longer period of time.

Thus, a racket, racket stringing pattern, kit, and method are disclosed which utilize anchors and a partially interwoven string region to more efficiently impart spin to a ball. While embodiments and applications of this invention have been shown and described, it would be apparent to those skilled in the art that many more modifications are possible without departing from the inventive concepts herein. For example, an independent anchoring member without a string therethrough could replace the upper and lower fourth cross strings extending through the anchor, and the string holes for the main strings could be staggered up and down along the head of the racket thereby creating the spacing between the cross strings and the main strings. Further, the elastomeric tubing can be omitted in which case a cross string would serve as the anchoring member. It is, therefore, to be understood that within the scope of the appended claims, this invention may be practiced otherwise than as specifically described.

What is claimed is:

1. A racket having a handle, a head with an opening, and a plurality of strings extending in at least two directions, the racket comprising:

a fully interwoven string region in the opening that is interwoven in two directions;

a partially interwoven string region in the opening that is interwoven in one direction;

the partially interwoven string region is adjacent the fully interwoven string region; and an anchoring member defining a boundary between the fully interwoven string region and the partially interwoven string region.

2. The racket according to claim 1 wherein the strings have a string diameter, the anchoring member is tubular, a string extending in a cross string direction extends through the anchoring member, and the anchoring member has an outer diameter greater than the string diameter so that the strings extending in a main string direction displace from an at rest position upon contact with an object.

3. The racket according to claim 2 wherein the outer diameter of the anchoring member is sized so that in the partially interwoven region, strings extending in the cross string direction do not contact strings extending in the main string direction when both are at rest.

4. The racket according to claim 1 further comprising a second fully interwoven string region adjacent the partially interwoven string region, and a second anchoring member defining a boundary between the partially interwoven string region and the second fully interwoven string region.

5. The racket according to claim 4 wherein the second fully interwoven string region is opposite the first fully interwoven string region.

6. The racket according to claim 1 wherein the anchor extends across a width of the tennis racket head.

7. The racket according to claim 1 wherein the anchor is interwoven only in a cross string direction.

8. The racket according to claim 1 wherein the partially interwoven string region is interwoven in a cross-string direction, and the fully interwoven string region is interwoven in both the cross string direction and a main string direction.

9. The racket according to claim 1 wherein the partially interwoven string region comprises at least eight cross strings.

10. A racket comprising:

a handle with a grip at one end;

a head connected to another end of the handle and the head defining an opening;

a plurality of strings being strung in at least two directions across the opening;

a lower string region interwoven in two directions being strung across the opening adjacent the handle;

an upper string region interwoven in two directions being strung across the opening opposite the handle;

a middle string region wherein the strings extending in a cross-string direction are in a middle plane, strings extending in a main string direction are in first and second outer planes on opposite sides of the middle plane, and the middle string region is interposed between the lower string region and the upper string region;

a lower anchoring member defining a boundary between the lower string region and the middle string region; and an upper anchoring member defining a boundary between the upper string region and the middle string region.

11. The racket according to claim 10 further comprising a plurality of vibration dampening components interposed between the lower anchor and upper anchor dampening vibration from the cross-string direction.

12. The racket according to claim 10 wherein the racket has a sweet spot centrally located in the opening, and the partially interwoven string region coincides with the sweet spot.

13. The racket according to claim 10 wherein the middle plane is spaced from the outer planes, and the middle plane is parallel to the outer planes.

14. The racket according to claim 10 wherein adjacent main strings lie in different outer planes.

* * * * *